US012220063B2

(12) United States Patent
Robinson et al.

(10) Patent No.: US 12,220,063 B2
(45) Date of Patent: Feb. 11, 2025

(54) PILLOW CAP

(71) Applicants: Stacey Robinson, Saginaw, MI (US); Tysan Robinson, Saginaw, MI (US)

(72) Inventors: Stacey Robinson, Saginaw, MI (US); Tysan Robinson, Saginaw, MI (US)

( * ) Notice: Subject to any disclaimer, the term of this patent is extended or adjusted under 35 U.S.C. 154(b) by 308 days.

(21) Appl. No.: 17/889,449

(22) Filed: Aug. 17, 2022

(65) Prior Publication Data

US 2023/0059540 A1 Feb. 23, 2023

Related U.S. Application Data

(60) Provisional application No. 63/234,748, filed on Aug. 19, 2021.

(51) Int. Cl.
*A47G 9/02* (2006.01)
*A47C 31/00* (2006.01)

(52) U.S. Cl.
CPC ..... *A47C 31/007* (2013.01); *A47G 9/0253* (2013.01)

(58) Field of Classification Search
CPC ..... A47C 31/007; A47G 9/0253; A47G 9/02
See application file for complete search history.

(56) References Cited

U.S. PATENT DOCUMENTS 4,480,347 A * 11/1984 Hawkins ..... A47G 9/0253 5/490
4,631,765 A * 12/1986 Casey ..... A47G 9/0207 428/33
5,168,590 A * 12/1992 O'Sullivan ..... A61F 7/02 5/639
5,706,535 A * 1/1998 Takashima ..... A47G 9/007 5/641
7,120,952 B1 * 10/2006 Bass ..... A47C 31/105 5/500
9,271,588 B1 * 3/2016 Phillips ..... A47G 9/04
12,053,112 B1 * 8/2024 Taylor ..... A47G 9/10
2004/0107502 A1 * 6/2004 Boone ..... A47G 9/0253 5/636
2008/0263767 A1 * 10/2008 Mooney ..... A47G 9/0253 5/490
2014/0157516 A1 * 6/2014 Geier ..... A44B 19/26 5/482
2015/0224217 A1 * 8/2015 Rogers ..... A61L 9/014 239/60
2016/0037769 A1 * 2/2016 Murphy ..... A01N 25/34 424/409
2016/0242580 A1 * 8/2016 Batiste ..... B32B 5/18
(Continued)

*Primary Examiner* — Justin C Mikowski
*Assistant Examiner* — Ifeolu A Adeboyejo
(74) *Attorney, Agent, or Firm* — Brennan, Manna & Diamond, LLC

(57) ABSTRACT

A protective pillow cover for protecting a pillow against germs and microbes. A barrier component is constructed with at least two layers configured in a generally cuboid shape defining a cavity. An inner layer employs an anti-microbial component creating a barrier between the user and the pillow. An outer layer is constructed with a material designed for the user's comfort. The layers terminate in a perimeter. A securing component shorter than the perimeter is integrated into the perimeter and is stretchable to allow the barrier component to partially encapsulate the pillow. A middle layer of the barrier component may be used to provide cooling or a pleasing olfactory experience.

19 Claims, 4 Drawing Sheets

(56) References Cited

U.S. PATENT DOCUMENTS

| | | | | |
|---|---|---|---|---|
| 2016/0345759 | A1* | 12/2016 | Arabov | A47G 9/0253 |
| 2017/0233240 | A1* | 8/2017 | Bouzis | A47G 9/1045<br>222/131 |
| 2019/0343290 | A1* | 11/2019 | Pierce | B60N 2/6063 |
| 2022/0211190 | A1* | 7/2022 | Forte | A47C 31/11 |
| 2023/0115359 | A1* | 4/2023 | Pierce | B60N 2/80<br>297/220 |
| 2023/0270972 | A1* | 8/2023 | Hall | A61G 11/008<br>600/26 |
| 2024/0164542 | A1* | 5/2024 | Peterson | B32B 7/12 |

* cited by examiner

PILLOW CAP

CROSS-REFERENCE TO RELATED APPLICATION

The present application claims priority to, and the benefit of, U.S. Provisional Application No. 63/234,748, which was filed on Aug. 19, 2021 and is incorporated herein by reference in its entirety.

FIELD OF THE INVENTION

The present invention generally relates to a protective barrier for a pillow. More specifically, the present invention relates to a multilayer barrier configured to protect pillows from microbes or other contamination. Accordingly, the present specification makes specific reference thereto. However, it is to be appreciated that aspects of the present invention are also equally amenable to other like applications, devices and methods of manufacture.

BACKGROUND

In light of the recent global pandemic, consumers and travelers have become more vigilant and wary of certain germ carriers and health hazards in their environment. One such item that has been overlooked in the past is your pillow. Hotels and hospitals for example, provide pillows to their respective guests and patients. Even with clean pillowcases provided, these pillows have already been used repeatedly by prior inhabitants, making their surfaces reservoirs for bacteria, viruses, and dust mites. Some travelers may opt to bring their own pillow with them to avoid multi-use pillows, but this is not a space conscious solution for those that are traveling light. Consumers need a feasible alternative that is less susceptible to contamination and will ensure their health is protected.

A pillow is designed to provide support and comfort to the body and head of the user. Pillows are typically constructed with a soft filler material that is enclosed in a fabric envelope cover or shell. Pillows have been historically made of a variety of natural materials and synthetic materials. Pillows are generally additionally often covered with a removable pillowcase, which facilitates laundering.

Germs, bacteria, viruses, microbes, and other pathogens are microscopic living things that exist everywhere throughout nature. A pathogen is a type of micro-organism that can potentially cause disease. Microbes are too small to be seen by the naked eye. Microbes are found in water, soil, and in the air. The most common types of microbes are bacteria, viruses, and fungi. Predominant ways to get into the body are by introducing these pathogens and organisms by inhalation or through mucus membranes. An antimicrobial is an agent that kills microorganisms or inhibits or stops their growth.

Disinfectants and sanitizing agents are used to control transmission of dangerous pathogens in indoor environments. Disinfectants and sanitizers have proven effective at reducing disease causing microorganisms that cause illness on a surface. Unfortunately, the cleaning effect of disinfectants and sanitizers is short lived, being limited to the point when recontamination of the surface occurs or the effective time of the disinfecting or sanitizing agent used. Once a surface is contaminated again, the pathogens will continue to survive until the area is disinfected again. Cloth, or plastic fiber based materials are not well suited to disinfecting or sanitizing agent usage due to their construction. Protective drapes are sometimes used as a protective measure in the therapeutic fields.

Recent health concerns surrounding the worldwide pandemic have generated a renewed interest in safer products. One such example is antimicrobial fabrics and their potential to protect against illness or exposure to bacteria and viruses. The treated fabrics help protect against microorganisms, or pathogens, that would normally contaminate traditional fabric products. They are used as an added layer of protection against the growth or spread of certain bacteria and other microorganisms.

Fabric products like hospital gowns and linens may employ antimicrobial healthcare fabrics to help promote clean, sanitary working environments. An antimicrobial fabric is any textile that offers protection against bacteria, mold, mildew, and other hazardous microbes. This can be achieved by treating the fabric with a topical chemical that inhibits the growth of pathogens or by using yarns which are designed to provide inherent microscopic antimicrobial functionality. Some naturally antimicrobial fabrics include linen, merino wool, and hemp.

Antimicrobial fabrics work by attacking pathogens on a cellular level to prevent their growth and reproduction. Different chemicals and textiles have different levels of effectiveness. Some products merely slow the spread of pathogens over time, while others are designed to kill contact. Unfortunately, clothing and linens typically offer a porous, warm, and hard-to-clean environment that is ideal for microbe growth.

When a microorganism, such as bacteria, comes into contact with an antimicrobial fabric, it breaks down in several ways. The antimicrobial agent impedes the microbe's genetics and its ability to reproduce. The agent increases oxygen levels causing internal damage to the microbe. It also damages the microbe's membrane, which adversely affects its supply of nutrients. It can assault the microbe's proteins, which hinders its essential functions. Common agents used to treat textiles are silver and copper because of their natural antimicrobial properties. The intended use of an antimicrobial fabric, as well as the manufacturer's capabilities, determine the process used to add the antimicrobial agent. The agents, or additives, may be applied to the surface of the textile or wound within its fibers. The agent may be added during the actual spinning of the fibers, combined with dyes, or applied as a treatment during finishing.

Accordingly, there is a great need for a better way to protect pillows from germs or other microbes. There is also a need for a way to obtain peace of mind when using a pillow while traveling. Similarly, there is a need for a reusable pillow protector designed to snugly fit most standard pillows. There is also a need for a pillow protector with multiple layers for both protecting the user and improving comfort. Further, there is a need for multi-layer pillow protector that is biodegradable and disposable.

In this manner, the improved multi-layer pillow protector of the present invention accomplishes all of the forgoing objectives, thereby providing an easy solution for protecting pillows from germs. A primary feature of the present invention is a reusable pillow protector designed to snugly fit most standard pillows without slipping. The present invention is designed with more than one layer for functionality and comfort. The multi-layer pillow protector may also be constructed to be biodegradable and disposable. Finally, the improved pillow protector of the present invention is capable of cinching on the underside of a pillow for a secure fit.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, comprises a protective pillow cover. The protective pillow cover is configured to partially encapsulate a pillow. The protective pillow cover comprises a barrier component and a securing component. The protective pillow cover may be disposable or reusable and washable.

The barrier component is configured in a generally cuboid shape defining a cavity adapted to receive the pillow. The barrier component comprises an inner layer and an outer layer. The inner and outer layers terminate in a generally rectangular perimeter. The inner and outer layers may be laminated together or may be secured together along the perimeter.

The outer layer is a comfort layer typically manufactured from a breathable soft material. The inner layer comprises an antimicrobial additive. The antimicrobial additive may be an antimicrobial agent, an antibiotic agent, an antifungal agent, an antiviral agent, or a combination thereof. The antimicrobial additive may impregnated or be coated or layered onto the inner layer. The inner layer is configured to act as a barrier to microbes.

The securing component is attached to or integrated into the perimeter of the barrier component. The securing component is stretchable to allow the barrier component to partially encapsulate the pillow within the cavity. The securing component may comprise a channel and an elastic element. The channel and elastic element may be attached to or integrated into the perimeter of the barrier component. The securing component is stretchable to allow the barrier component to partially encapsulate and retain the pillow within the cavity.

The subject matter disclosed and claimed herein, in another embodiment thereof, comprises a protective pillow cover. The protective pillow cover is configured to partially encapsulate a pillow. He protective pillow cover comprises a barrier component and a securing component. The protective pillow cover may be disposable or reusable and washable.

The barrier component is configured in a generally cuboid shape defining a cavity adapted to receive the pillow. The barrier component comprises an inner layer, a middle layer, and an outer layer. The inner, middle, and outer layers terminate in a generally rectangular perimeter. The inner middle, and outer layers may be laminated together or may be secured together along the perimeter.

The outer layer is a comfort layer typically manufactured from a breathable soft material. The inner layer comprises an antimicrobial additive. The antimicrobial additive may be an antimicrobial agent, an antibiotic agent, an antifungal agent, an antiviral agent, or a combination thereof. The antimicrobial additive may impregnated or be coated or layered onto the inner layer. The inner layer is configured to act as a barrier to microbes.

The middle layer is sandwiched between the inner and outer layers. The middle layer may comprise a pocket. The middle layer may comprise a layer of cooling gel. Alternatively, the middle layer may comprise an olfactory element impregnated in or coated on the middle layer. Alternatively, the protective pillow cover may further comprise an insertable olfactory element. The insertable olfactory element is configured to be retained within the pocket of the middle layer.

The securing component is attached to or integrated into the perimeter of the barrier component. The securing component is stretchable to allow the barrier component to partially encapsulate the pillow within the cavity. The securing component comprises an elastic element. The elastic element may be attached to or integrated into the perimeter of the barrier component. The securing component is stretchable to allow the barrier component to partially encapsulate and retain the pillow within the cavity.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
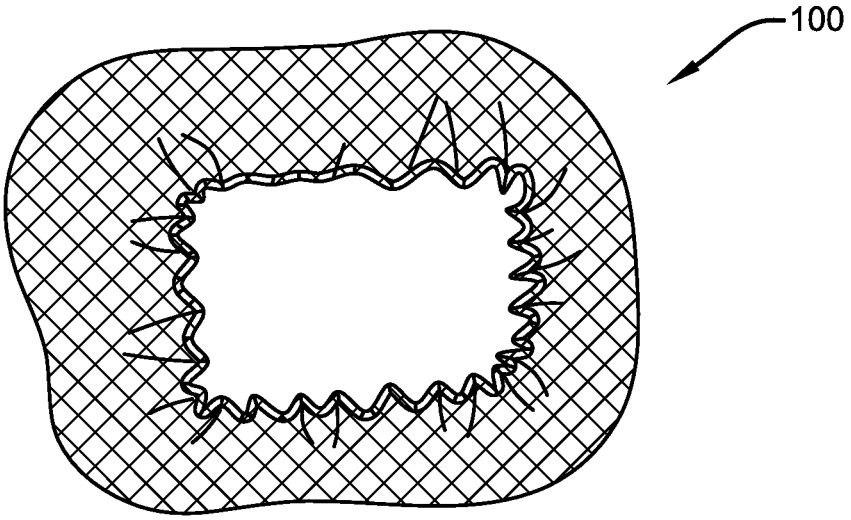
FIG. 1 illustrates a perspective underside view of a protective pillow cover of the present invention for protecting a pillow in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They do not intend as an exhaustive description of the invention or do not limit the scope of the invention. Additionally, an illustrated embodiment need not have all the aspects or advantages shown. Thus, in other embodiments, any of the features described herein from different embodiments may be combined.

The subject matter disclosed and claimed herein, in one embodiment thereof, comprises a multilayered germ resistant pillow covering for consumers and travelers. The protective pillow cover may be configured to accommodate a scented insert or gel cooling layer for the user's comfort. The protective pillow cover includes a cap-like cinching component on the underside for a secure fit over any pillow. The protective pillow cover may be a reusable washable model or single-use disposable one. The protective pillow cover offers users peace of mind and eases anxiety for a better night's sleep.

The protective pillow cover is similar in appearance to a large shower cap or pillowcase consisting of two or more biodegradable layers. A top layer is where the user rests their head. The exterior is constructed from a soft textured material for comfort. A second layer may comprise a gel cooling insert for users who like to keep cool at night. Alternatively, the second layer can also be comprised of an insert with calming scents for users who have trouble sleeping. An innermost layer is composed of sterile antimicrobial material and acts as a germ resistant barrier between the pillow and the user. The protective pillow cover further comprises a cap-like cinching on the underside. This flexible elastic rim allows the cap to easily stretch and fit over the user's pillow. The protective pillow cover hugs and grips the pillow so that it stays in securely in place when in use. Dimensions of the protective pillow cover will vary depending on whether the protective pillow cover is to be used for travel pillows or standard size 18"×24" pillows.

Figure 2:
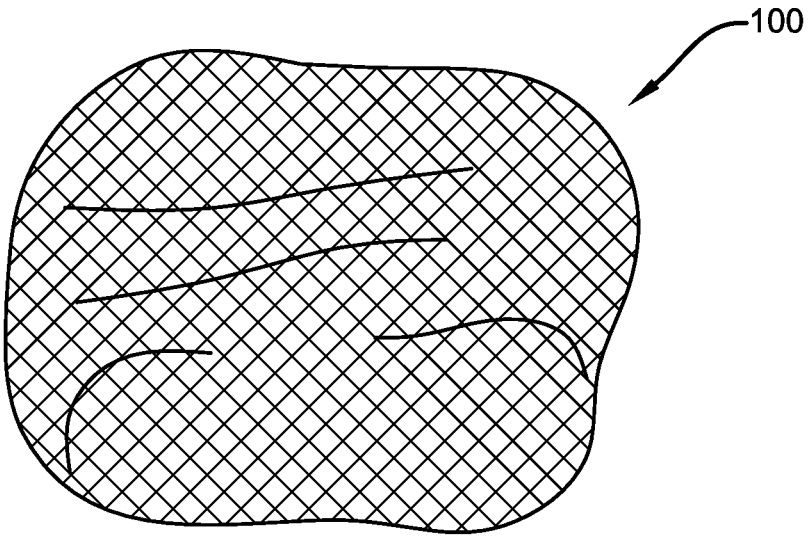
FIG. 2 illustrates a perspective topside view of the protective pillow cover of the present invention for protecting a pillow in accordance with the disclosed architecture.
Figure 3:
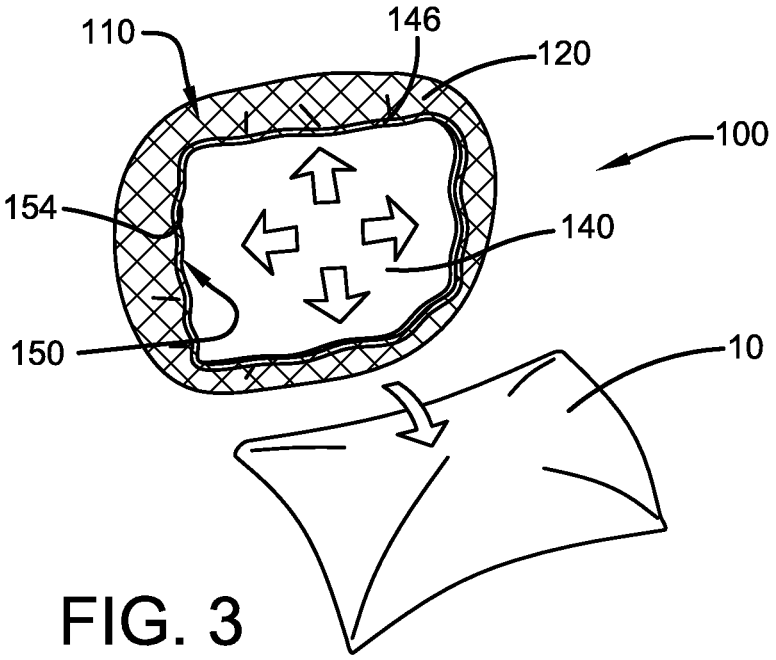
FIG. 3 illustrates a perspective view of the protective pillow cover of the present invention separated from a pillow in accordance with the disclosed architecture.
Figure 4:
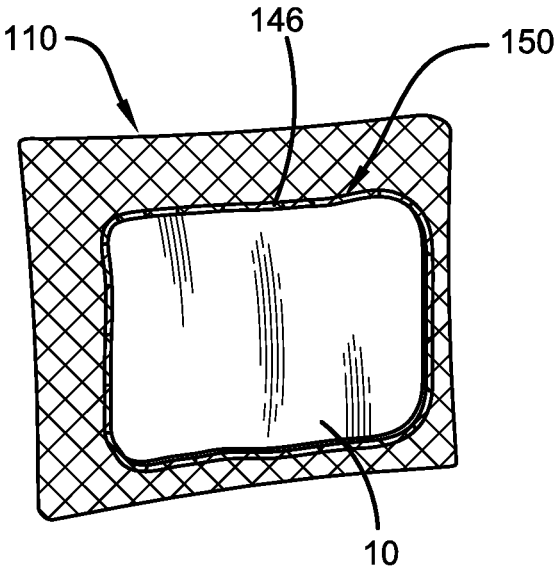
FIG. 4 illustrates a perspective underside view of the protective pillow cover of the present invention in place over a pillow in accordance with the disclosed architecture.
Figure 5:
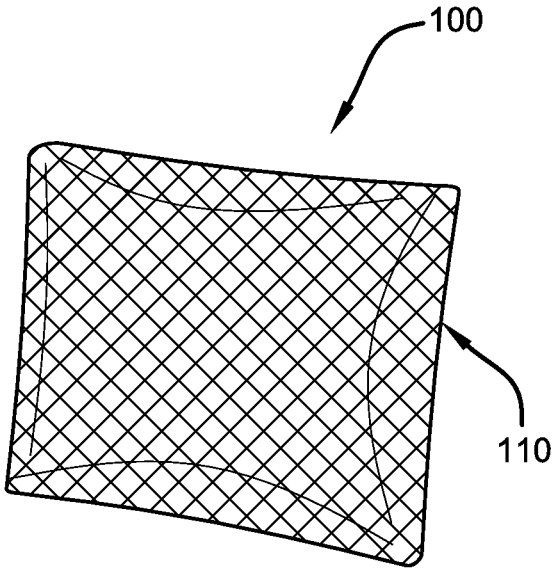
FIG. 5 illustrates a perspective topside view of the protective pillow cover of the present invention in place over a pillow in accordance with the disclosed architecture.

Referring initially to the drawings, FIGS. 1-7, the present invention, in one exemplary embodiment, is a protective pillow cover 100. The protective pillow cover 100 is configured to fit over and at least partially encapsulate a pillow 10 as illustrated in FIGS. 4 and 5. As illustrated in FIGS. 1 and 2, the protective pillow cover 100 comprises a barrier component 110 and a securing component 150. The protective pillow cover 100 may be disposable or reusable and washable depending on construction.

The barrier component 100 is configured in a generally cuboid shape defining a cavity 148 adapted to receive the pillow 10. The generally cuboid shape is typically rectangular, but may be square, oval, or circular depending on the shape of the pillow to be protected. The barrier component 110 may be constructed from biodegradable materials. A top of the pillow 10 will be completely covered and a bottom of the pillow 10 will be partially covered when the protective pillow cover 100 is in place around the pillow 10.

Figure 7:
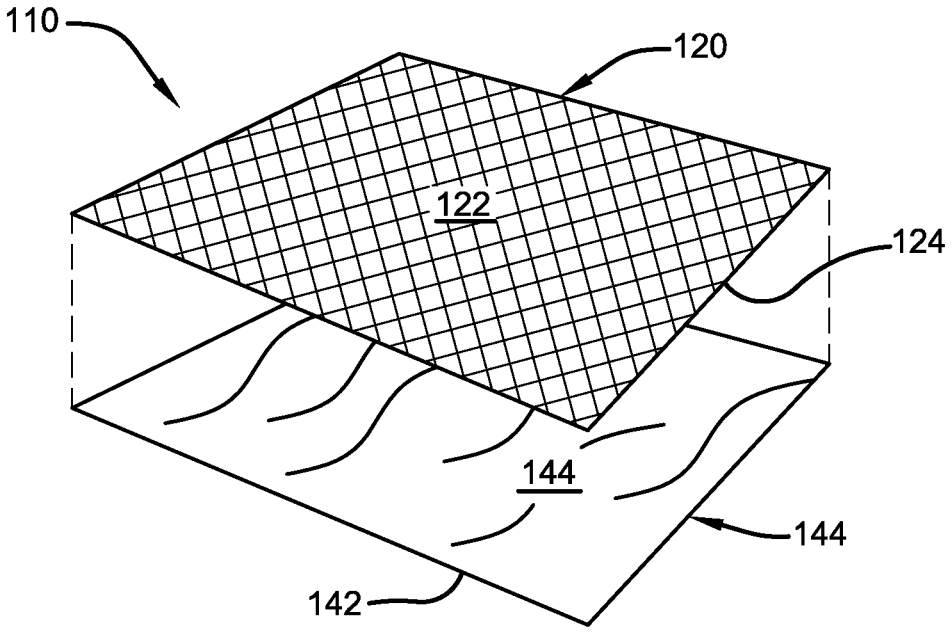
FIG. 7 illustrates an exploded view of an outer layer and an inner layer of a barrier component of the protective pillow cover of the present invention for protecting a pillow in accordance with the disclosed architecture.

As illustrated in FIG. 7, the barrier component 100 comprises an inner layer 140 and an outer layer 120. The inner layer 140 comprises an exterior surface 142 and an interior surface 144. The exterior surface 142 may have a semi-rough texture to prevent sliding and abuts the pillow 10 when the protective pillow cover 100 is in place around the pillow 10. The outer layer 120 comprises an exterior surface 122 and an interior surface 124. The exterior surface 122 of the outer layer 120 is the user contact surface. The interior surface 144 of the inner layer 140 abuts the interior surface 124 of the outer layer 120.

The inner and outer layers 140 and 120 terminate in a generally rectangular perimeter 146. The inner and outer layers 140 and 120 may be laminated or adhered together or may be secured together along the generally rectangular perimeter 146 by stitching, reinforcing, bonding, welding, fusing, heat sealing, or the like, or any other type of seam construction.

The outer layer 120 is a comfort layer typically manufactured from a breathable soft material, such as a fabric. The fabric may be, but is not limited to a knit fabric, a woven fabric, a non-woven fabric, or the like. The fabric may be constructed from natural fibers such as cotton, synthetic fibers such as polyester, or a combination of natural fibers and synthetic fibers.

The inner layer 140 is constructed from a barrier or nonbreathable material, may be waterproof or water resistant, and may comprise an antimicrobial additive. The antimicrobial additive may be an antimicrobial agent or compound with antimicrobial properties, an antibiotic agent, an antifungal agent, an antiviral agent, or a combination thereof. The antimicrobial additive may impregnated or be coated or layered onto the inner layer 140 or may be applied to the yarn used for the fabric. The inner layer 140 is configured to act as a barrier to microbes. The antimicrobial additive may include an antimicrobial effective amount of copper or silver. The inner layer 140 may also be constructed from a filter material having a high degree of filtration pathogens, such as that used in medical masks or other very tightly woven material. The inner layer 140 may also be coated with a monolithic or microporous material to prevent penetration by moisture and allergens such as dust mites, mold, and bacteria.

Figure 6:
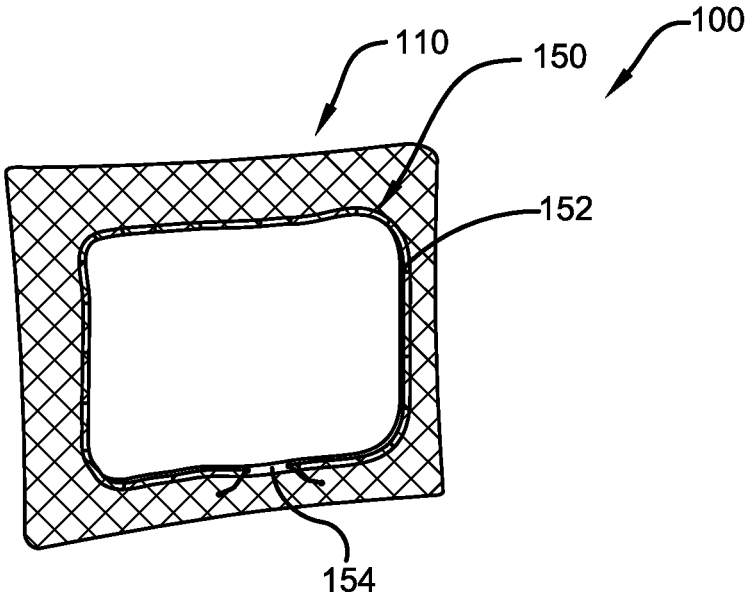
FIG. 6 illustrates a perspective underside view of the protective pillow cover of the present invention for protecting a pillow in accordance with the disclosed architecture.

As illustrated in FIGS. 3 and 4, the securing component 150 is attached to or integrated into the perimeter 146 of the barrier component 110. The securing component 150 is stretchable to allow the barrier component 110 to partially encapsulate the pillow 10 within the cavity 148 as illustrated in FIG. 3. The securing component 150 may comprise a channel 152 and an elastic element 154. The channel 152 and elastic element 154 may be attached to or integrated into the perimeter 146 of the barrier component 110. Alternatively, the elastic element 154 is an elastic band integrated into the channel 152 attached to the perimeter 146 of the barrier component 110. The securing component 150 is stretchable to allow the barrier component 110 to partially encapsulate and retain the pillow 10 within the cavity. As illustrated in FIG. 6, the elastic element 154 may be adjustable in length to allow for different sized pillows.

Figure 8:
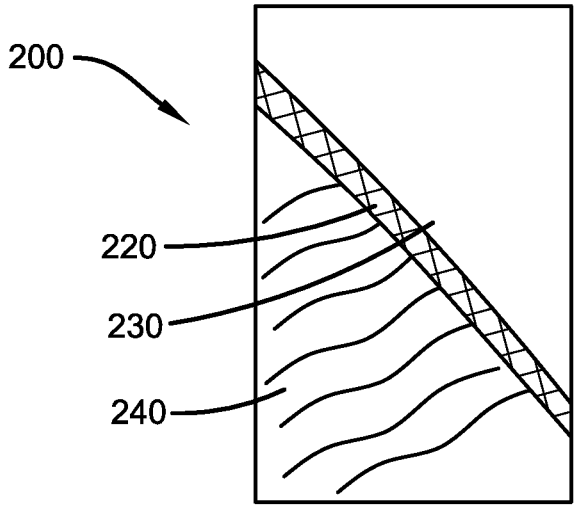
FIG. 8 illustrates a closeup end view of an outer layer, an inner layer, and a middle layer of a barrier component of the protective pillow cover of the present invention for protecting a pillow in accordance with the disclosed architecture.
Figure 9:
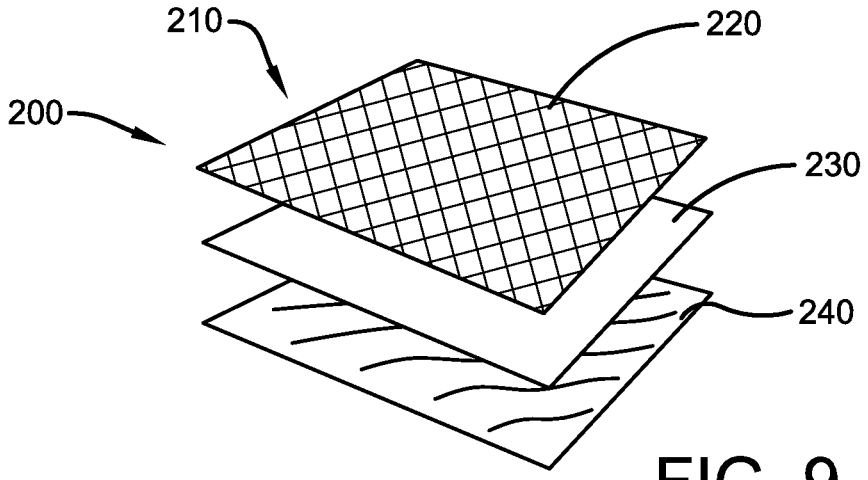
FIG. 9 illustrates an exploded view of the outer layer, the inner layer, and a middle layer of the barrier component of the protective pillow cover of the present invention for protecting a pillow in accordance with the disclosed architecture.
Figure 10:
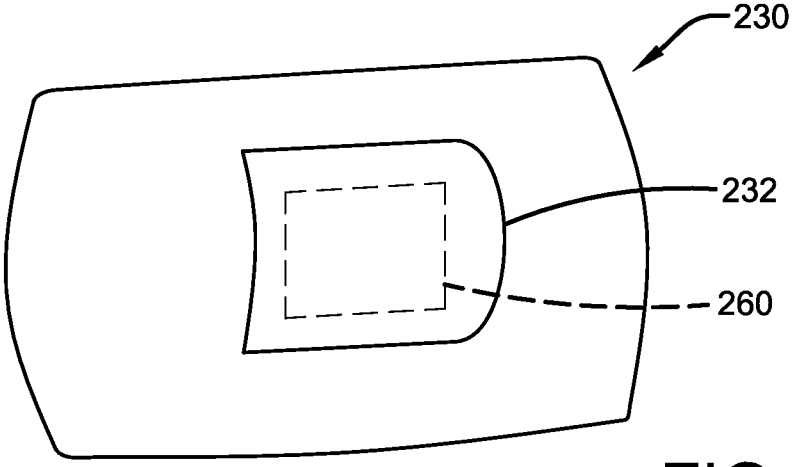
FIG. 10 illustrates a perspective view of the middle layer of the barrier component of the protective pillow cover of the present invention for protecting a pillow in accordance with the disclosed architecture.

As illustrated in FIGS. 8-10, the subject matter disclosed and claimed herein, in another embodiment thereof, comprises a protective pillow cover 200. The protective pillow cover 200 is configured to partially encapsulate a pillow 10. The protective pillow cover 200 comprises a barrier component 210 and a securing component (similar to 150). The protective pillow cover 200 may be disposable or reusable and washable.

The barrier component 200 is configured in a generally cuboid shape defining a cavity (similar to 148) adapted to receive the pillow 10. As illustrated in FIGS. 8 and 9, the barrier component 200 comprises an inner layer 240, a middle layer 230, and an outer layer 220. The inner, middle, and outer layers 240, 230, and 220 terminate in a generally rectangular perimeter (similar to 146). The inner middle, and outer layers 240, 230, and 220 may be laminated together or may be secured together along the perimeter as described supra.

The outer layer 220 is a comfort layer typically manufactured from a breathable soft material, such as a fabric. The fabric may be, but is not limited to a knit fabric, a woven fabric, a non-woven fabric, or the like. The fabric may be constructed from natural fibers such as cotton, synthetic fibers such as polyester, or a combination of natural fibers and synthetic fibers.

The inner layer 240 is constructed from a barrier or nonbreathable material and comprises an antimicrobial additive. The antimicrobial additive may be an antimicrobial agent or compound with antimicrobial properties, an antibiotic agent, an antifungal agent, an antiviral agent, or a combination thereof. The antimicrobial additive may impregnated or be coated or layered onto the inner layer 240. The inner layer 240 is configured to act as a barrier to microbes. The antimicrobial additive may include an antimicrobial effective amount of copper or silver. The inner layer 240 may also be constructed from a filter material having a high degree of filtration pathogens, such as that used in medical masks or other very tightly woven material. The inner layer 240 may also be coated with a monolithic or microporous material to prevent penetration by moisture and allergens such as dust mites, mold, and bacteria.

The middle layer 230 is sandwiched between the inner and outer layers 240 and 220. As illustrated in FIG. 10, the middle layer 230 may comprise a pocket 232. The middle layer 230 may be removable and replaceable. The middle layer 230 may comprise a layer of cooling gel. Alternatively, the middle layer 230 may comprise an olfactory element impregnated in or coated on the middle layer 230. The olfactory element is a scented compound with soothing or calming odors emitted. The olfactory element may use lavender, citrus, peppermint, or other pleasing scents. Alternatively, the protective pillow cover 200 may further comprise an insertable olfactory element 260. The insertable olfactory element 260 is configured to be retained within the pocket 232 of the middle layer 230.

The securing component (similar to 150) is attached to or integrated into the perimeter of the barrier component 210. The securing component is stretchable to allow the barrier component 210 to partially encapsulate the pillow 10 within the cavity. The securing component may comprise a channel (similar to 152) and an elastic element (similar to 154). The channel and elastic element may be attached to or integrated into the perimeter of the barrier component 210. Alternatively, the elastic element is an elastic band integrated into the channel attached to the perimeter of the barrier component 210. The securing component is stretchable to allow the barrier component 210 to partially encapsulate and retain the pillow 10 within the cavity.

Notwithstanding the forgoing, the protective pillow covers 100 and 200 can be any suitable size, shape, and configuration as is known in the art without affecting the overall concept of the invention, provided that it accomplishes the above stated objectives. One of ordinary skill in the art will appreciate that the shape and size of the protective pillow covers 100 and 200 and its various components, as show in the FIGS. are for illustrative purposes only, and that many other shapes and sizes of the protective pillow covers 100 and 200 are well within the scope of the present disclosure. Although dimensions of the protective pillow covers 100 and 200 and its components (i.e., length, width, and height) are important design parameters for good performance, the protective pillow covers 100 and 200 and its various components may be any shape or size that ensures optimal performance during use and/or that suits user need and/or preference. As such, the protective pillow covers 100 and 200 may be comprised of sizing/shaping that is appropriate and specific in regard to whatever the protective pillow covers 100 and 200 is designed to be applied.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A protective pillow cover comprising:

a barrier component configured in a generally cuboid shape comprising an inner layer and an outer layer terminating in a perimeter and defining a cavity adapted to receive a pillow; and a securing component attached to the perimeter of the barrier component; and wherein the securing component is stretchable to allow the barrier component to partially encapsulate the pillow within the cavity; and wherein the inner layer comprises a textured exterior surface configured to prevent sliding when abutting the pillow; and wherein the inner layer further comprises a copper additive.

2. The protective pillow cover of claim 1, wherein the inner layer further comprises an antimicrobial additive.

3. The protective pillow cover of claim 2, wherein the antimicrobial additive comprises an antibiotic agent, an antifungal agent, and an antiviral agent.

4. The protective pillow cover of claim 1, wherein the protective pillow cover is washable.

5. The protective pillow cover of claim 1, wherein the barrier component is biodegradable.

6. The protective pillow cover of claim 1, wherein the generally cuboid shape is rectangular.

7. The protective pillow cover of claim 1, wherein the securing component comprises an elastic band integrated into a channel attached to the perimeter of the barrier component.

8. The protective pillow cover of claim 1, wherein the inner and outer layers are laminated together.

9. The protective pillow cover of claim 1, wherein the inner layer is a non-breathable material and the outer layer is a breathable fabric.

10. A protective pillow cover comprising:

a barrier component configured in a generally cuboid shape comprising an inner antimicrobial layer and an outer comfort layer terminating in a perimeter and defining a cavity adapted to receive a pillow; and a securing component comprising a channel and an elastic element integrated into the perimeter of the barrier component; and wherein the securing component is stretchable to allow the barrier component to partially encapsulate and retain the pillow within the cavity; and wherein the inner antimicrobial layer comprises a textured exterior surface configured to prevent sliding when abutting the pillow; and wherein the inner antimicrobial layer further comprises a copper additive and is coated with a microporous material.

11. The protective pillow cover of claim 10, wherein the inner antimicrobial layer is impregnated with an antimicrobial additive.

12. The protective pillow cover of claim 10, wherein the inner antimicrobial layer is layered with an antimicrobial additive coating.

13. The protective pillow cover of claim 10, wherein the inner and outer layers are secured together along the perimeter.

14. The protective pillow cover of claim 10, wherein the elastic element is adjustable in length.

15. A protective pillow cover comprising:

a barrier component configured in a generally cuboid shape comprising an antimicrobial inner layer, a middle layer, and an outer comfort layer terminating in a perimeter and defining a cavity adapted to receive a pillow; and a securing component comprising an elastic element integrated into the perimeter of the barrier component; and wherein the securing component is stretchable to allow the barrier component to partially encapsulate and retain the pillow within the cavity; and wherein the antimicrobial inner layer comprises a textured exterior surface configured to prevent sliding when abutting the pillow; and wherein the antimicrobial inner layer further comprises a copper additive and is coated with a microporous material; and wherein the middle layer comprises a layer of cooling gel and a pocket.

16. The protective pillow cover of claim 15, wherein the inner antimicrobial layer is impregnated or coated with an antimicrobial agent, an antibiotic agent, an antifungal agent, and an antiviral agent.

17. The protective pillow cover of claim 15 further comprising an olfactory element insertable into the pocket of the middle layer.

18. The protective pillow cover of claim 15, wherein the middle layer is impregnated or coated with an olfactory element.

19. The protective pillow cover of claim 15, wherein the middle layer is removable.

* * * * *